US008181590B2

(12) United States Patent
Siesjö et al.

(10) Patent No.: US 8,181,590 B2
(45) Date of Patent: May 22, 2012

(54) SLUICE DEVICE FOR AN ROV

(75) Inventors: Jan Siesjö, Ljungsbro (SE); Bo Rydell, Motala (SE)

(73) Assignee: SAAB AB, Linköping (SE)

( * ) Notice: Subject to any disclaimer, the term of this patent is extended or adjusted under 35 U.S.C. 154(b) by 105 days.

(21) Appl. No.: 12/670,423

(22) PCT Filed: Jul. 22, 2008

(86) PCT No.: PCT/EP2008/059587

§ 371 (c)(1),
(2), (4) Date: Jan. 25, 2010

(87) PCT Pub. No.: WO2009/013288

PCT Pub. Date: Jan. 29, 2009

(65) Prior Publication Data

US 2010/0212572 A1 Aug. 26, 2010

(30) Foreign Application Priority Data

Jul. 25, 2007 (EP) ..... 07113109

(51) Int. Cl.
*B63G 8/00* (2006.01)

(52) U.S. Cl. ..... 114/321; 114/312

(58) Field of Classification Search ..... 114/48, 114/312, 316, 321, 322; 367/131
See application file for complete search history.

(56) References Cited

U.S. PATENT DOCUMENTS

| | | | | |
|---|---|---|---|---|
| 4,306,413 | A | 12/1981 | Middleton | |
| 4,721,055 | A | 1/1988 | Pado | |
| 5,447,115 | A * | 9/1995 | Moody | 114/312 |
| 5,868,524 | A | 2/1999 | Martin | |
| 6,167,831 | B1 | 1/2001 | Watt et al. | |
| 6,502,527 | B1 * | 1/2003 | Danielson | 114/312 |
| 7,798,086 | B2 * | 9/2010 | Ruggaber | 114/312 |

FOREIGN PATENT DOCUMENTS

| | | |
|---|---|---|
| EP | 0 236 026 A2 | 9/1987 |
| JP | 03-266794 | 11/1991 |
| WO | WO 03/097445 | 11/2003 |

OTHER PUBLICATIONS

International Preliminary Report on Patentability, dated Nov. 10, 2009, issued in connection with counterpart International Patent Application No. PCT/EP2008/059587.

International Search Report, dated Nov. 24, 2008, issued in connection with counterpart International Patent Application No. PCT/EP2008/059587.

Attilio Brighenti, et al.,"Eurodocker—A Universal Docking—Downloading—Recharging System for AUVs: Conceptual Design Results," Oceans '98 Conference Proceedings, Nice, France, Sep. 28-Oct. 1, 1998.

* cited by examiner

*Primary Examiner* — Lars A Olson

(74) *Attorney, Agent, or Firm* — Venable LLP; Eric J. Franklin

(57) ABSTRACT

A sluice device suitable for a remotely cable operated vehicle. A water tight compartment has a first and a second sluice gate. The sluice device includes a system for enabling launching, operating, and retrieving of the remotely cable operated vehicle. An insert for converting an existing torpedo tube to a sluice device, and a torpedo shaped transport container for an insert.

16 Claims, 4 Drawing Sheets

SLUICE DEVICE FOR AN ROV

CROSS-REFERENCE TO RELATED APPLICATIONS

This application claims priority to European patent application 07113109.8 filed 25 Jul. 2007 and is the national phase under 35 U.S.C. §371 of PCT/EP2008/059587 filed 22 Jul. 2008.

TECHNICAL FIELD OF THE INVENTION

The present invention refers to sluice devices for remotely cable operated underwater vehicles. It also refers to an insert for upgrading an existing torpedo tube of a submarine to become such a sluice device.

BACKGROUND OF THE INVENTION

"Remotely operated vehicle" (ROV) is a term normally used to designate an under-water vehicle operated from a surface vessel via a cable, said cable is sometimes called "tether", or "umbilical cord" or just "umbilical", with or without the extension "cable". The purpose of operating the ROV may be all kinds of missions, for example technical maintenance of underwater installations within the offshore industry, search, investigation of accidents or surfacing of parts from crashed aircraft or sunken vessels, or general research of sea bed.

Another purpose, and a main reason for using an ROV in a defense application, is the advantage to be able to perform operations in a concealed manner, hidden from enemy eyes and ears. Such operations may include surveillance missions etc.

However, at great depths the lengths of the umbilical cable may become a practical problem. It would therefore be convenient if the ROV could be operated from a submarine, which could bring the ROV close to the object of interest, thereby eliminating at least part of the need of cable length from surface down to operating depth.

Another benefit of operating the ROV from a submarine would be the almost lack of bad weather conditions. Surface storms, heave of the sea, and similar conditions are not present below the sea surface. This would therefore allow missions to be initiated without waiting for good weather.

U.S. Pat. No. 4,306,413 disclose a hydraulic power and control system for an elongated container able to house an underwater vehicle and which is capable of being mounted on the deck of a submarine. The container has top door means capable of being opened for release or recovery of the underwater vehicle.

The article "EURODOCKER—A Universal Docking—Downloading—Recharging System for AUVs: Conceptual Design Result" by Attilio Brighent et al, OCEANS '98 CONFERENCE PROCEEDINGS NICE, FRANCE 28 Sep. -1 Oct. 1998, NEW YORK, N.Y., USA, IEEE, US, vol 3, September 1998 (1998-Sep.-28) pages 1463-1467, XP010311858 ISBN: 0-7803-5045-6 discloses a managing system for AUVs (Autonomous Underwater Vehicles) including a submerged docking station for AUVs.

EP 0 169 219 B1 describes a remotely operated underwater vehicle and method of operating the same.

EP 0 236 026 A2 describes a tether cable management apparatus and method for a remotely operated underwater vehicle.

U.S. Pat. No. 5,868,524 describe a clamp system and method for connecting tubular bodies together.

The use of wires to control a torpedo is well known in the art. However the problem of controlling a torpedo is different from that of controlling an ROV. First, a torpedo is a disposable, single use type of equipment. Therefore, there is no incentive for developing torpedo tubes and wire control devices that enable control of a torpedo to return to the submarine and swim back into the torpedo tube. On the contrary, this could be a very risky endeavour.

On the other hand, when operating an ROV it would be highly desirable to have the possibility to make the ROV to return to the submarine where it was launched and to completely retrieve it.

A first problem to be solved is how to rewind umbilical cable when the ROV returns to the submarine. A second problem is how to avoid the cable from becoming entangled. A third problem is how to prevent the cable from wearing against parts of the sluice device and/or the submarine itself A fourth problem is to provide a device for solving the first and second problem easily and at a reasonable cost.

It is an object of the present invention to provide a device that solves the above described problems.

This object is fulfilled according to the invention by a sluice device.

SUMMARY

In fact, the present invention refers to a sluice device, such as a torpedo tube of a submarine, which has been provided with means for allowing a cable operated ROV to be launched, operated and retrieved with the aid of said sluice device. The sluice device is provided with a telescopic cable guide apparatus for guiding the cable via a pulley arrangement arranged at its distal end. The cable guide apparatus is able to telescopically fold between an extended position and a folded position within the sluice device, thereby making it possible to close a distal sluice gate of the sluice device.

Further, the sluice device is provided with a constant tension cable winch to keep a constant tension in the tether cable, for preventing the cable from getting tangled. The sluice is further provided with proper cable guiding means for guiding the cable from the pulley arrangement in the distal end of the telescopic cable guide apparatus to the cable winch.

In preferred embodiments the sluice device for operating an ROV is achieved by combining an existing torpedo tube with a special torpedo tube insert, the insert comprising the necessary parts to convert the torpedo tube to a sluice device for an ROV as described above, i.e., it comprises a telescopic cable guide and a cable winch and possibly an emergency cable cutter.

In a further preferred embodiment the insert is provided as part of a torpedo shaped transport container having the dimensions and shape of a torpedo for the torpedo tube such that taking aboard and installation can be performed easily in the submarine. The container also having the ability to house all necessary equipment to be able to operate the ROV, e.g., the ROV itself, an operators console, power and control electronics. Special tools necessary for mounting may also be housed.

The transport container is provided with means for securing the necessary equipment to the inside of the transport container. The transport container is further provided with means to be opened and stored onboard the submarine, where it will serve as a storage device for the necessary equipment. Approximately half-way its middle third the transport casing is divisible into a wet end portion and a dry end portion. The wet end portion is intended to be mounted inside the torpedo tube, and is provided with means to house the ROV itself and the cable cutter and cable winch. The dry end portion is intended to be mounted in a suitable place within the submarine to allow an operator to control the ROV.

Thus accordingly, there is provided a kit of parts comprising the parts of the torpedo tube insert and transport container of above and further comprising an operators console and a power electronics cabinet, and a control electronics cabinet, and where the transport container and the console and cabinets are adapted such that the operators console and the power electronics cabinet, and the control electronics cabinet are contained and enclosed within the torpedo shape of said transport container and within standard torpedo dimensions of said transport container. The operators console and the power electronics cabinet, and the control electronics cabinet are arranged in the dry end portion. The dry end portion and the wet end portion are separated by a dividing wall. The cable winch and cable guiding machinery, including the telescopic guiding apparatus as described above is arranged in the wet end portion. A such kit of parts solves much of the practical problems concerning ease of transport and installation arising when trying to modify an existing torpedo tube onboard an existing submarine to be able to function as a launching and retrieval device for a cable controlled, remotely operated vehicle.

BRIEF DESCRIPTION OF THE DRAWINGS

Embodiments of the invention will now be described, by way of example, with reference to the accompanying drawings, wherein.

DETAILED DESCRIPTION OF PREFERRED EMBODIMENTS

Figure 1A:
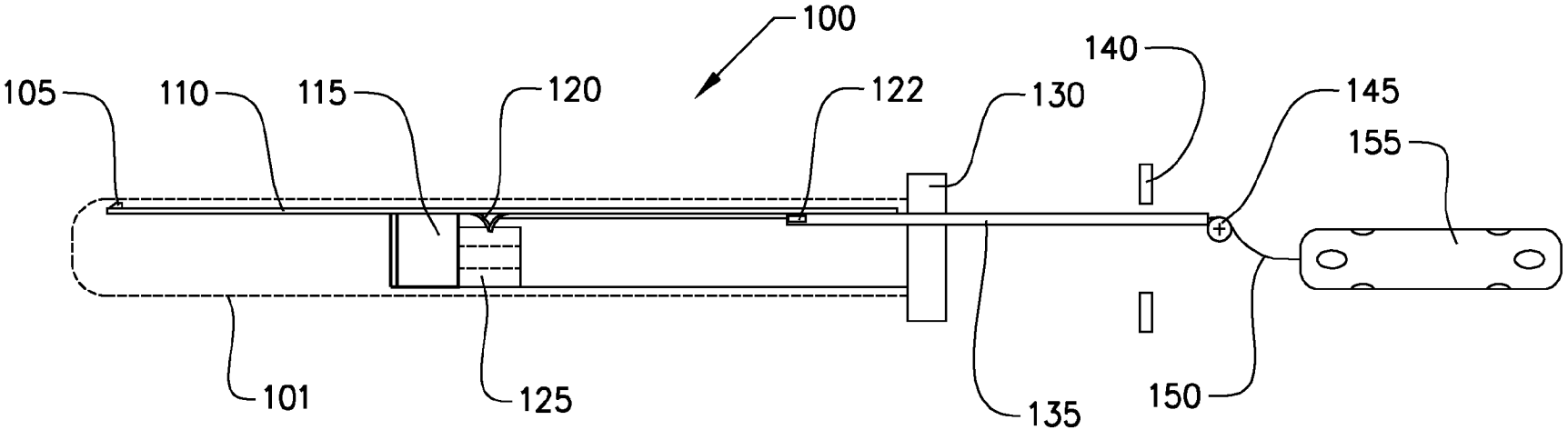
FIG. 1*a* shows a side view of an ROV sluice device in an ROV operating position.
Figure 1B:
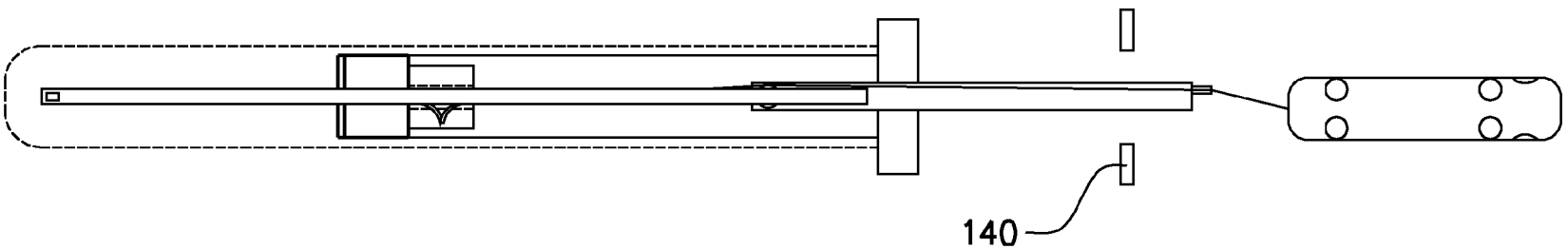
FIG. 1*b* shows the ROV sluice device of FIG. 1*a* as seen from above.

FIG. 1*a* shows a side view, and FIG. 1*b* shows a view from above, of an ROV sluice device 100 in an ROV operating position. Within a torpedo tube 101 is provided a winch box 115 comprising a winch drive motor and control electronics for unwinding and winding the umbilical cable with even tension. The box may also include power conversion means for providing appropriate power for drive motor. The winch drive motor is mechanically connected to a winch drum 125. The winch drum 125 is preferably arranged having its axis of rotation parallel with the length axis of the torpedo tube 101.

Inside the torpedo tube 101 is mounted a rail 110 for a telescopic cable guide 135. The telescopic cable guide comprises preferably an elongated member 135 slideable along the rail 110 from a folded position where it is contained within the length of the torpedo tube 101, to an extracted position where a distal end 145 of the elongated member becomes positioned a distance outside the submarine outside hull. The elongated member 135 is provided with appropriate first 120 , second 122, and third 145 cable guiding organs for appropriately guiding the cable 150 from the cable drum 125 to alongside the rail, further along the elongated member 135, and further, at the distal end, guiding the cable 150 between the distal end 145 of the elongated member 135 and the ROV 155. In fig. la and b the telescopic cable guide 135 is shown in an extracted position. The telescopic cable guide is preferably arranged to be extracted by the movement of the ROV 155 when the ROV 155 is launched, and folded by the force exerted by the cable winch when the ROV 155 is pulled back into the torpedo tube 101. In another embodiment the extraction and withdrawing of the elongated member 135 may be accomplished by means of a separate drive organ, e.g., an electric motor properly coordinated with the winch drum drive motor. The elongated member 135 is preferably hollow, i.e., of a tubular design, allowing the cable to run inside the tubular design.

Shown on FIG. 1*a* and 1*b* is also a front hatch 130 of the torpedo tube and the submarine outside hull 140, represented by boxes 140. A locking shoulder 105 may be provided to secure the rail to the torpedo tube wall.

Figure 2A:
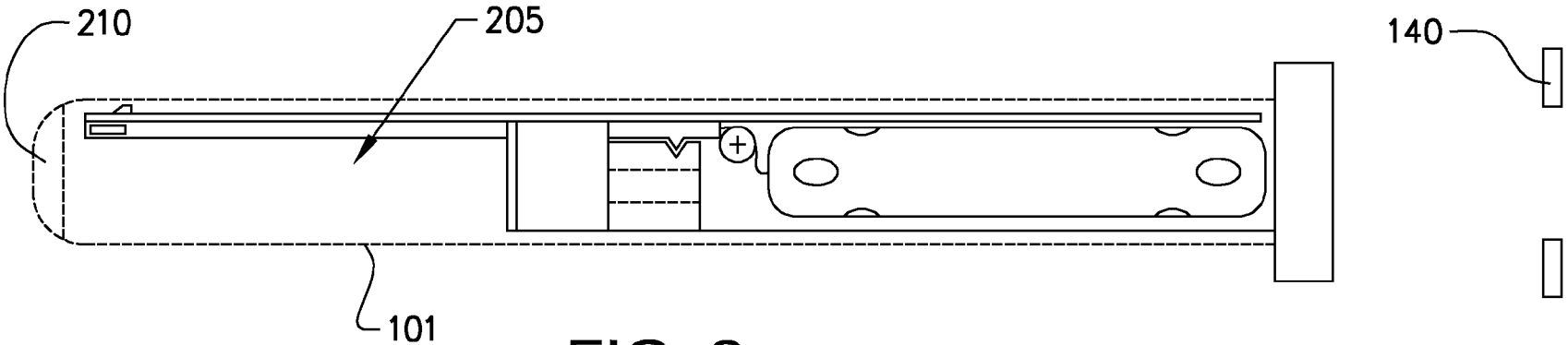
FIG. 2*a* shows a side view of the sluice device of FIG. 1*a* in a stand by position.
Figure 2B:
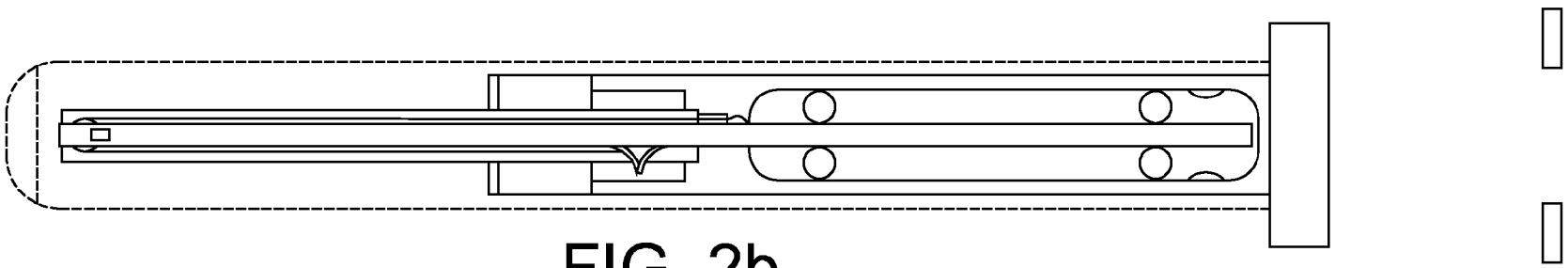
FIG. 2*b* shows the sluice device of FIG. 2*a* as seen from above.

FIG. 2*a* shows a side view of the sluice device of FIG. 1*a* in a stand by position. FIG. 2*b* shows the sluice device of FIG. 2*a* as seen from above.

The inventive concept also comprises a method for converting an existing torpedo tube for regular torpedoes to a sluice device for a remotely cable operated vehicle, the method comprising the following steps:

Providing a torpedo tube;

Providing an ROV insert;

Opening the rear hatch 210 of the torpedo tube 101;

Sliding the ROV insert via the torpedo tube rear hatch 210 into the torpedo tube;

Connecting control electronics of the ROV insert to an existing electrical internal connector of the interior of the torpedo tube.

The method may further comprise the following steps:

Providing a container for ROV electronics and ROV operators console;

Mounting said operators console at a convenient place inside the submarine;

Mounting ROV electronics at a convenient place inside the submarine;

Connecting ROV electronics to submarine mains or similar;

Connecting electronics to torpedo tube external connector for connecting to winch and ROV via internal connector of torpedo tube.

Figure 3A:
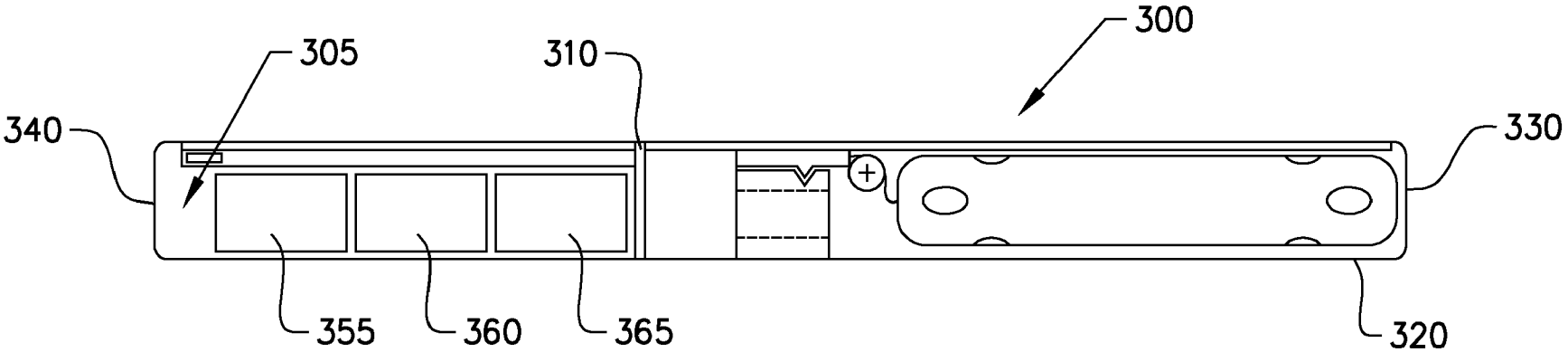
FIG. 3*a* shows a side view of a transport container for an ROV system including a tube converting insert.
Figure 3B:
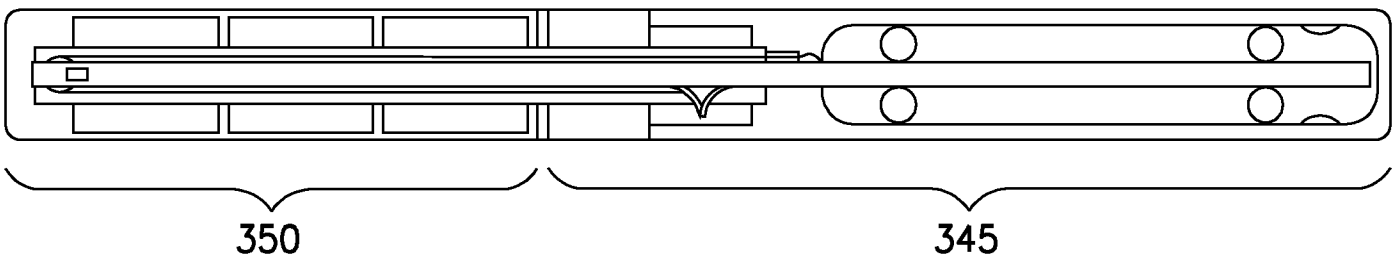
FIG. 3*b* shows the transport container of FIG. 3*a* as seen from above.

FIG. 3*a* shows a side view of a transport container 300 for an ROV system including a torpedo tube converting insert. The container 300 having a front end 330 and an aft end 340. The insert comprises an ROV launching frame 320 and a cable guidance system together with winch box and winch drum. The cable guidance system comprises a rail and an elongated member, and first, second and third cable guidance organs as described above. The transport container can be divided into a front 345 and an aft portion 350 along a dividing wall 310. The dividing wall is preferably arranged somewhere between one third and two thirds of transport container length from aft end. The torpedo tube converting insert comprises front end of container and components as described above. FIG. 3*b* shows the transport container of FIG. 3*a* as seen from above. The aft portion 350 of the transport container 300 may hereinafter be referred to as the "dry portion of the container". The dry portion of the container is devised to house, during transport, an operator's console 355, a power electronics cabinet 360 and a control electronics cabinet 365.

Figure 4A:
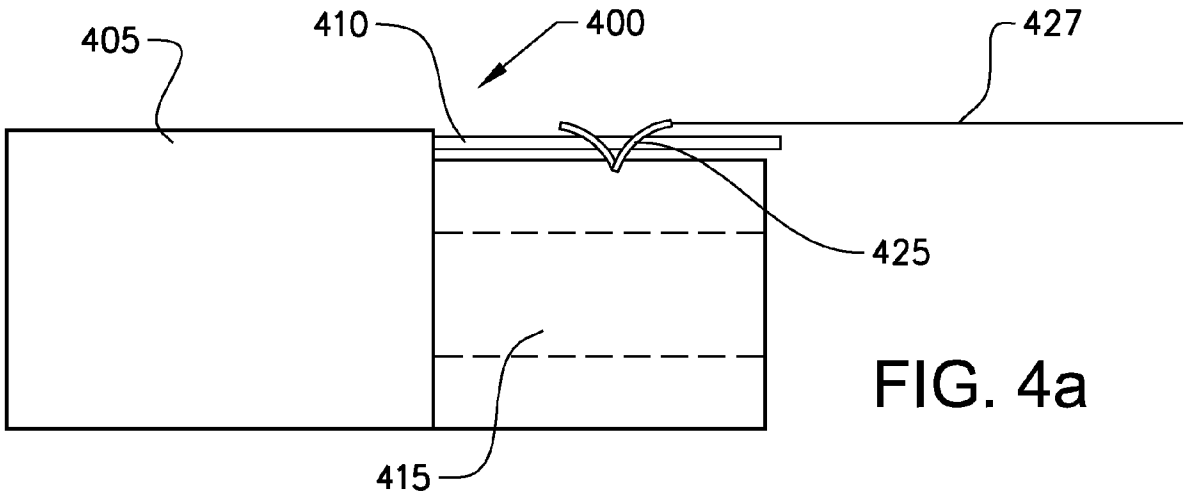
FIG. 4*a* shows winch box and a winch drum together with a first cable guide organ for sluice device of FIG. 1*a*.

FIG. 4*a* shows a winch box 405 and a winch drum 415 together with a first cable guidance organ 425 for sluice device of FIG. 1*a*. Parallel to the axis of the cable drum 415 is arranged a diamond screw for distributing the cable evenly over the drum 415. In alternative embodiments other organs for even distribution may be considered.

In a preferred embodiment a first cable guiding organ 420 comprises a cable guide member 425 that is arranged to be articulated such that it may turn around the diamond screw and guides the cable down towards the periphery of the cable drum 415. The cable guide member 425 is preferably a curved sliding chute or a curved rail having a number of rolls enabling the cable to run with low friction.

Figure 4B:
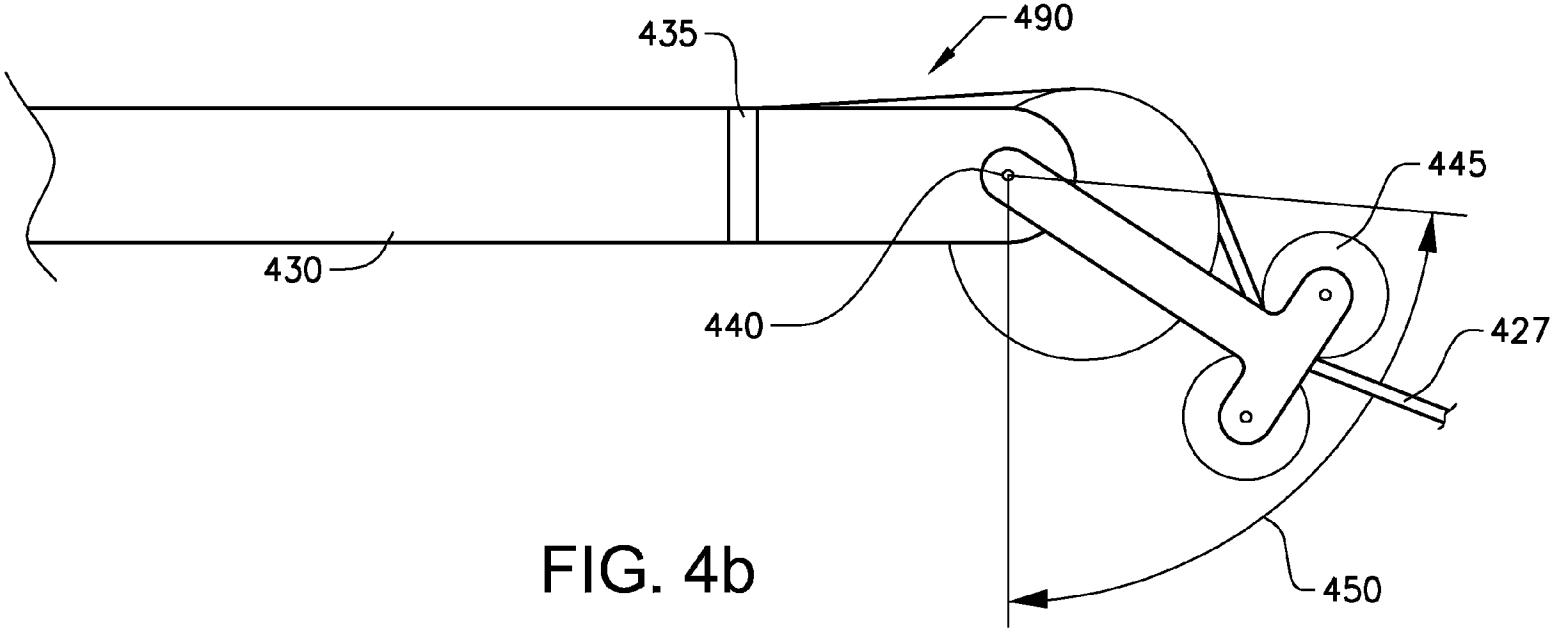
FIG. 4*b* shows a third cable guiding organ for the sluice device of FIG. 1*a*.

FIG. 4*b* shows in a side view a third cable guiding organ 490 for the sluice device of FIG. 1*a*. The third cable guiding organ 490 is arranged at a distal end of the elongated member 430. It comprises a first articulated joint 435 that permits a cable pulley with a further cable guiding member rotate freely around an axis parallel to a length axis of the elongated member 430. The third cable guiding organ 490 further comprises a second articulated joint 440 permitting the further cable guiding member to pivot from approximately 5 to 90 degrees relatively to the direction of the length axis of the elongated member 430. The first and second articulated joints 435, 440 may be combined in the same joint. The projection into the plane of the drawing of the range of movement 450 of the cable guide guiding organ is indicated by dashed line. Support wheels 445 are arranged where the cable 427 leaves and enters the cable guiding organ 490.

Legend

100 Sluicing device
101 Torpedo tube
105 Locking shoulder
110 Rail/Guide
115 Winch and transformer
120 First cable guide
122 Second cable guide
125 Winch drum
130 Distal sluice gate
135 Cable protection with explosive bolt
140 Submarine outer hull
145 Cable pulley
150 Umbilical cable
155 ROV
205 Wet end of torpedo tube insert
300 ROV system transport container
305 Dry portion of transport container
310 Dividing wall
400 Cable management device
405 Winch box
410 Diamond screw
415 Cable drum
425 Cable guide member
427 Cable
430 Elongated member
435 Articulated joint 1
440 Articulated joint 2
445 Support wheels
450 Range of movement
490 Third cable guide

The invention claimed is:

1. A sluice device suitable for a remotely cable operated vehicle, comprising a water tight compartment having a front hatch and a rear hatch, the front hatch being arranged for the vehicle to enter and leave the water tight compartment; and a system for enabling launching, operating, and retrieving of the remotely cable operated vehicle, said system including a cable winch and a cable guidance system for preventing the cable to wear against portions of the sluice device, and for preventing the cable from becoming entangled, and wherein the cable guidance system comprises a telescopic guide apparatus able to telescopically fold between an extended position and a folded position, and wherein said telescopic guide apparatus comprises a rail in the watertight compartment, and an elongated member slideable along said rail for sliding said elongated member to an extended position where a distal end of said elongated member reaches a distance outside the front hatch and with a cable guide configured to guide the cable from the cable winch to the distal end of the elongated member.

2. The sluice device according to claim 1, further comprising:

a cable winch drum; and a control for said drum to maintain an even tension in the cable.

3. A torpedo tube, comprising:

a water tight compartment having a front hatch and a rear hatch, the front hatch being arranged for the vehicle to enter and leave the water tight compartment; and a torpedo tube insert for converting the torpedo tube to a sluice device suitable for a remotely cable operated vehicle, said torpedo tube insert comprising a system for enabling launching, operating, and retrieving of the remotely cable operated vehicle, said system including an ROV launching frame, a cable winch and a cable guidance system for preventing the cable from wearing against portions of the torpedo tube, and for preventing the cable from becoming entangled, and wherein the cable guidance system comprises a telescopic guide apparatus able to telescopically fold between an extended position and a folded position, wherein said telescopic guide apparatus comprises a rail intended for the watertight compartment, and an elongated member slideable along said rail for sliding said elongated member to an extended position where a distal end of said elongated member is devised to reach a distance outside the front hatch and with a cable guide configured to guide the cable from the cable winch to the distal end of the elongated member.

4. The torpedo tube according to claim 3, further comprising:

a cable winch drum; and a control for said drum to maintain an even tension in the cable.

5. The torpedo tube according to claim 4, wherein a sliding of said elongated member to a folded or extended position is accomplished by letting a separate driving device provide mechanical energy needed for sliding.

6. A sluice device suitable for a remotely cable operated vehicle, comprising:

a water tight compartment having a front hatch and a rear hatch;

a system configured to enable launching, operating, and retrieving of the remotely cable operated vehicle, said system including a cable winch and a cable guidance system for preventing the cable to wear against portions of the sluice device, and for preventing the cable from becoming entangled, and wherein the cable guidance system comprises a telescopic guide apparatus able to telescopically fold between an extended position and a folded position, wherein a sliding of said elongated member to an extended position is accomplished by letting the remotely operated vehicle provide mechanical energy needed for sliding.

7. The sluice device according to claim 6, wherein a sliding of said elongated member to a folded position is accomplished by letting the cable winch provide the mechanical energy needed for sliding.

8. The sluice device according to claim 6, wherein a sliding of said elongated member to a folded or extended position is accomplished by letting a separate driving device provide the mechanical energy needed for sliding.

9. A sluice device suitable for a remotely cable operated vehicle, comprising a water tight compartment having a front hatch and a rear hatch, the front hatch being arranged for the vehicle to enter and leave the water tight compartment;

a system for enabling launching, operating, and retrieving of the remotely cable operated vehicle, said system including a cable winch and a cable guidance system for preventing the cable to wear against portions of the sluice device, and for preventing the cable from becoming entangled, and wherein the cable guidance system comprises a telescopic guide apparatus able to telescopically fold between an extended position and a folded position;

a cable winch drum; and a control for said drum to maintain an even tension in the cable wherein the cable winch drum is arranged with its axis of rotation parallel with a length axis of the sluice device.

10. The sluice device according to claim 9, wherein a diamond screw is arranged parallel to the axis of the cable drum for distributing the cable evenly over the cable drum.

11. A torpedo tube, comprising:

a water tight compartment having a front hatch and a rear hatch, the front hatch being arranged for the vehicle to enter and leave the water tight compartment; and a torpedo tube insert for converting the torpedo tube to a sluice device suitable for a remotely cable operated vehicle, said torpedo tube insert comprising a system for enabling launching, operating, and retrieving of the remotely cable operated vehicle, said system including an ROV launching frame, a cable winch and a cable guidance system for preventing the cable from wearing against portions of the torpedo tube, and for preventing the cable from becoming entangled, and wherein the cable guidance system comprises a telescopic guide apparatus able to telescopically fold between an extended position and a folded position, wherein said telescopic guide apparatus comprises a rail intended for the watertight compartment, and an elongated member slideable along said rail for sliding said elongated member to an extended position where a distal end of said elongated member is devised to reach a distance outside the front hatch and with a cable guide configured to guide the cable from the cable winch to the distal end of the elongated member, wherein a sliding of said elongated member to an extended position is accomplished by letting the remotely operated vehicle provide mechanical energy needed for sliding.

12. A torpedo tube, comprising:

a water tight compartment having a front hatch and a rear hatch, the front hatch being arranged for the vehicle to enter and leave the water tight compartment;

a torpedo tube insert for converting the torpedo tube to a sluice device suitable for a remotely cable operated vehicle, said torpedo tube insert comprising a system for enabling launching, operating, and retrieving of the remotely cable operated vehicle, said system including an ROV launching frame, a cable winch and a cable guidance system for preventing the cable from wearing against portions of the torpedo tube, and for preventing the cable from becoming entangled, and wherein the cable guidance system comprises a telescopic guide apparatus able to telescopically fold between an extended position and a folded position, wherein said telescopic guide apparatus comprises a rail intended for the watertight compartment, and an elongated member slideable along said rail for sliding said elongated member to an extended position where a distal end of said elongated member is devised to reach a distance outside the front hatch and with a cable guide configured to guide the cable from the cable winch to the distal end of the elongated member;

a cable winch drum; and a control for said drum to maintain an even tension in the cable, wherein a sliding of said elongated member to a folded position is accomplished by letting the cable winch provide mechanical energy needed for sliding.

13. A torpedo tube, comprising:

a water tight compartment having a front hatch and a rear hatch, the front hatch being arranged for the vehicle to enter and leave the water tight compartment;

a torpedo tube insert for converting the torpedo tube to a sluice device suitable for a remotely cable operated vehicle, said torpedo tube insert comprising a system for enabling launching, operating, and retrieving of the remotely cable operated vehicle, said system including an ROV launching frame, a cable winch and a cable guidance system for preventing the cable from wearing against portions of the torpedo tube, and for preventing the cable from becoming entangled, and wherein the cable guidance system comprises a telescopic guide apparatus able to telescopically fold between an extended position and a folded position, wherein said telescopic guide apparatus comprises a rail intended for the watertight compartment, and an elongated member slideable along said rail for sliding said elongated member to an extended position where a distal end of said elongated member is devised to reach a distance outside the front hatch and with a cable guide configured to guide the cable from the cable winch to the distal end of the elongated member;

a cable winch drum; and a control for said drum to maintain an even tension in the cable, wherein the cable winch drum is arranged with its axis of rotation parallel with a length axis of the sluice device.

14. The torpedo tube according to claim 13, wherein a diamond screw is arranged parallel to the axis of the cable drum for distributing the cable evenly over the cable drum.

15. A torpedo tube, comprising:

a water tight compartment having a front hatch and a rear hatch, the front hatch being arranged for the vehicle to enter and leave the water tight compartment;

a torpedo tube insert for converting the torpedo tube to a sluice device suitable for a remotely cable operated vehicle, said torpedo tube insert comprising a system for enabling launching, operating, and retrieving of the remotely cable operated vehicle, said system including an ROV launching frame, a cable winch and a cable guidance system for preventing the cable from wearing against portions of the torpedo tube, and for preventing the cable from becoming entangled, and wherein the cable guidance system comprises a telescopic guide apparatus able to telescopically fold between an extended position and a folded position; and a transport container for an ROV system, wherein said container has a shape and dimensions of a torpedo and is adapted to provide a housing of the insert, and wherein the transport container is divisible at a dividing wall positioned between one third and two thirds of transport container length from an aft end.

16. A torpedo tube, comprising:

a water tight compartment having a front hatch and a rear hatch, the front hatch being arranged for the vehicle to enter and leave the water tight compartment;

a torpedo tube insert for converting the torpedo tube to a sluice device suitable for a remotely cable operated vehicle, said torpedo tube insert comprising a system for enabling launching, operating, and retrieving of the remotely cable operated vehicle, said system including an ROV launching frame, a cable winch and a cable guidance system for preventing the cable from wearing against portions of the torpedo tube, and for preventing the cable from becoming entangled, and wherein the cable guidance system comprises a telescopic guide apparatus able to telescopically fold between an extended position and a folded position, wherein said telescopic guide apparatus comprises a rail intended for the watertight compartment, and an elongated member slideable along said rail for sliding said elongated member to an extended position where a distal end of said elongated member is devised to reach a distance outside the front hatch and with a cable guide configured to guide the cable from the cable winch to the distal end of the elongated member;

an operators console, a power electronics cabinet, and a control electronics cabinet, wherein the transport container and the console and cabinets are adapted such that the operators console and the power electronics cabinet, and the control electronics cabinet, are contained within the torpedo shape and within the dimensions of said transport container.

* * * * *